US007208666B2

(12) United States Patent
Burch et al.

(10) Patent No.: US 7,208,666 B2
(45) Date of Patent: Apr. 24, 2007

(54) INSTRUMENT CASE STAND

(75) Inventors: Chad Burch, 839 Alahaki St., Kailua, HI (US) 96734; Charles E. Burch, Jr., Honolulu, HI (US); John Guest, Aylmer (CA)

(73) Assignees: Chad Burch, Kailua, HI (US); Charles Burch, Jr., Honolulu, HI (US)

( * ) Notice: Subject to any disclaimer, the term of this patent is extended or adjusted under 35 U.S.C. 154(b) by 124 days.

(21) Appl. No.: 10/985,648

(22) Filed: Nov. 10, 2004

(65) Prior Publication Data

US 2005/0126366 A1 Jun. 16, 2005

Related U.S. Application Data

(60) Provisional application No. 60/518,961, filed on Nov. 10, 2003.

(51) Int. Cl.
*G10G 5/00* (2006.01)

(52) U.S. Cl. ..... 84/327; 84/290; 84/329; 248/243; 248/653; 248/649

(58) Field of Classification Search ..... 84/290, 84/327, 329; 248/443, 653, 649
See application file for complete search history.

(56) References Cited

U.S. PATENT DOCUMENTS 2,007,535 A * 7/1935 Kapnek ..... 248/455
2,474,450 A * 6/1949 Woodruff ..... 108/132
2,768,668 A * 10/1956 Santosuosso ..... 206/315.7
2,782,890 A * 2/1957 Powell et al. ..... 190/108
2,834,526 A * 5/1958 Paris ..... 182/16
3,249,073 A * 5/1966 Gorham ..... 108/134
3,632,073 A * 1/1972 Nakatani ..... 248/169
3,866,877 A * 2/1975 Thompson ..... 248/688
3,994,527 A * 11/1976 Nikitits et al. ..... 297/158.4
4,147,254 A * 4/1979 Bruce ..... 206/314
4,215,839 A * 8/1980 Gibran ..... 248/170
4,223,785 A * 9/1980 Jacques ..... 206/314
4,474,290 A 10/1984 DeMato
4,618,119 A * 10/1986 Powell ..... 248/456
4,738,180 A 4/1988 McKnight
5,193,672 A * 3/1993 Long ..... 206/45.2
5,197,701 A * 3/1993 Olson ..... 248/166
D350,862 S * 9/1994 Beller ..... D6/429
5,415,285 A * 5/1995 Reimers ..... 206/315.7
5,438,786 A * 8/1995 Hilderbrand ..... 42/94

(Continued)

*Primary Examiner*—Lincoln Donovan
*Assistant Examiner*—Robert W. Horn
(74) *Attorney, Agent, or Firm*—Clayton, Howarth & Cannon, P.C.

(57) ABSTRACT

A stand device for use with objects such as musical instrument cases. The stand can be attached to an instrument case for supporting the instrument case in an upright position. The musical instrument may be stored within the case for protection against the elements or accidental damage. The stand may be placed in an extended position for supporting the musical instrument case, or the stand may be retracted to a compact configuration to facilitate transporting, storing and handling the stand. The stand may include a body that may be attachable to the instrument case through a pair of connectors and a brace member. The body may also have a pair of legs for providing additional stability to the stand. When the stand is retracted, the connectors, brace member and legs may be received within the body so as to be out of view.

26 Claims, 9 Drawing Sheets

U.S. PATENT DOCUMENTS 5,576,722 A * 11/1996 Bustillos ..... 343/882
5,597,144 A * 1/1997 Lee ..... 248/96
5,713,543 A * 2/1998 Ruth et al. ..... 248/96
5,713,553 A * 2/1998 Cooper ..... 248/461
5,718,401 A * 2/1998 Walters ..... 248/150
5,797,578 A * 8/1998 Graffeo et al. ..... 248/453
5,829,585 A * 11/1998 Kao et al. ..... 206/315.3
5,829,720 A * 11/1998 Shiao ..... 248/96
5,833,051 A 11/1998 Tiefenbrun et al.
5,887,833 A * 3/1999 Sundara et al. ..... 248/96
6,007,032 A * 12/1999 Kuo ..... 248/185.1
6,121,527 A 9/2000 Hamm
6,130,375 A 10/2000 Kellogg et al.
6,145,801 A * 11/2000 Herring, Jr. ..... 248/463
6,170,792 B1 * 1/2001 Miceli et al. ..... 248/441.1
6,326,531 B1 12/2001 Bremmer
6,422,522 B1 7/2002 Woollen
6,462,260 B2 * 10/2002 Fediakov ..... 84/327
6,462,718 B1 * 10/2002 Ehrenberg et al. ..... 343/880
6,487,807 B1 * 12/2002 Kopman et al. ..... 42/94
6,612,320 B2 * 9/2003 Lin et al. ..... 135/33.41
6,622,421 B1 * 9/2003 Daniels ..... 43/4.5
6,622,644 B2 * 9/2003 Buono ..... 108/132
6,659,440 B2 * 12/2003 Levy ..... 269/45
6,951,280 B1 * 10/2005 Lee ..... 206/314
6,959,810 B2 * 11/2005 Neilson ..... 206/314
7,044,068 B2 * 5/2006 Stanford ..... 108/132
7,077,229 B2 * 7/2006 Lee ..... 180/220
2002/0104426 A1 * 8/2002 Fediakov ..... 84/329
2004/0007117 A1 * 1/2004 Howard ..... 84/327
2004/0182984 A1 * 9/2004 Sandkuhl ..... 248/443
2005/0126366 A1 * 6/2005 Burch et al. ..... 84/327

* cited by examiner

INSTRUMENT CASE STAND

CROSS-REFERENCE TO RELATED APPLICATIONS

This application claims the benefit of U.S. Provisional Application No. 60/518,961, filed Nov. 10, 2003, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present disclosure relates generally to support devices, and more particularly, but not necessarily entirely, to stand devices that can be attached to objects such as instrument cases to support instruments in an upright position.

2. Description of Related Art

Musicians are commonly faced with the challenge of finding a place to safely store their musical instruments. For example, musicians who play stringed instruments such as guitars, cellos, or banjos, often need a place to store their instruments when they are not in use. Such musical instruments may be expensive and may be damaged if not properly protected. Musical instruments are sometimes stored by placing the instrument on the floor and leaning the instruments against a wall or furniture for support. This is an undesirable method of storing the instruments since the musical instrument may slip from its stored position causing damage to either the instrument, the wall, or the furniture on which the instrument is supported.

It is a common practice to provide instrument stands to support musical instruments in an upright position when the instruments are not in use. Sometimes the stands are configured to attach directly to the musical instrument which may leave the instrument exposed for damage and require additional space to store the instrument case. Storing a musical instrument out of its case causes the instrument to be more vulnerable to damage from dust, or accidental damage from children or pets for example. Other instrument stands may be bulky and difficult to transport, store, or manipulate, or the instrument stands may be unsightly in appearance.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
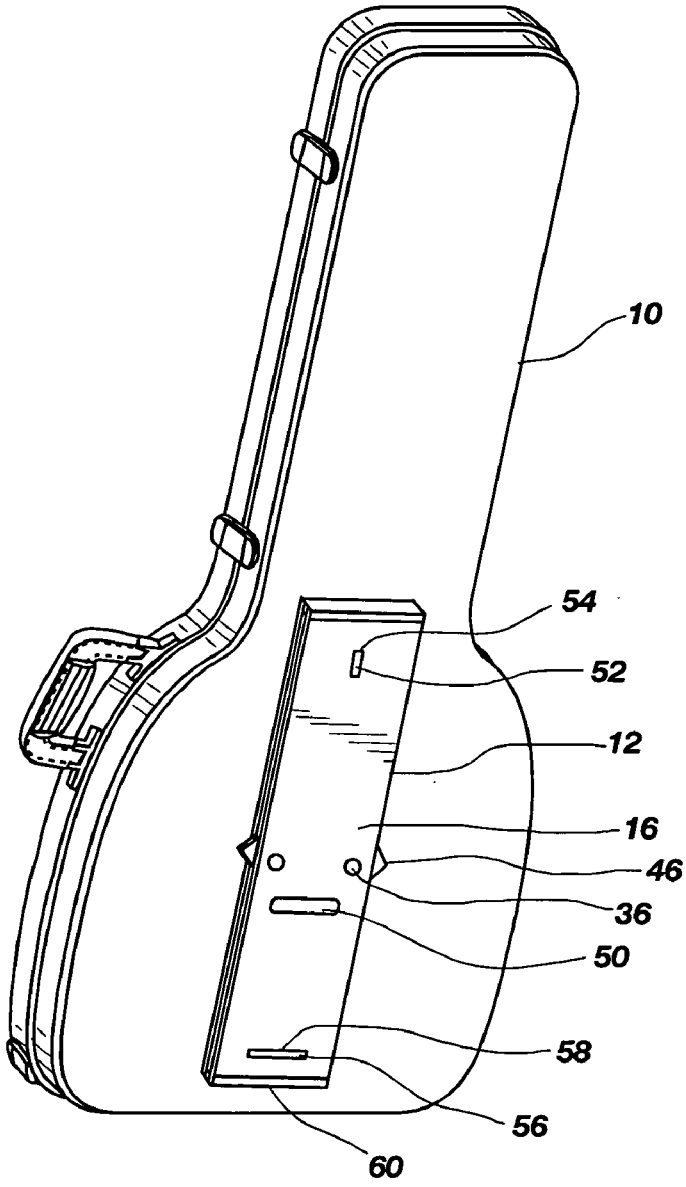
FIG. 1 is a perspective view of an instrument case and a stand device attached thereto in a retracted position in accordance with the principles of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise. Moreover, as used herein, the terms "comprising," "including," "containing," "characterized by," and grammatical equivalents thereof are inclusive or open-ended terms that do not exclude additional, unrecited elements or method steps.

Referring now to FIG. 1, a perspective view is shown of an instrument case 10 and a stand device 12 attached thereto in accordance with the principles of the present disclosure. The instrument case 10 may be used for any variety of musical instruments, such as a guitar, bass, banjo, or cello, for example, or any other musical instrument. It will also be understood that the principles of the present disclosure may be used for any other object, besides a musical instrument, in which it is desired to support the object, such as in an upright position; Moreover, it will be appreciated that the stand device 12 may be attached directly on a musical instrument, rather than the case 10.

Figure 2:
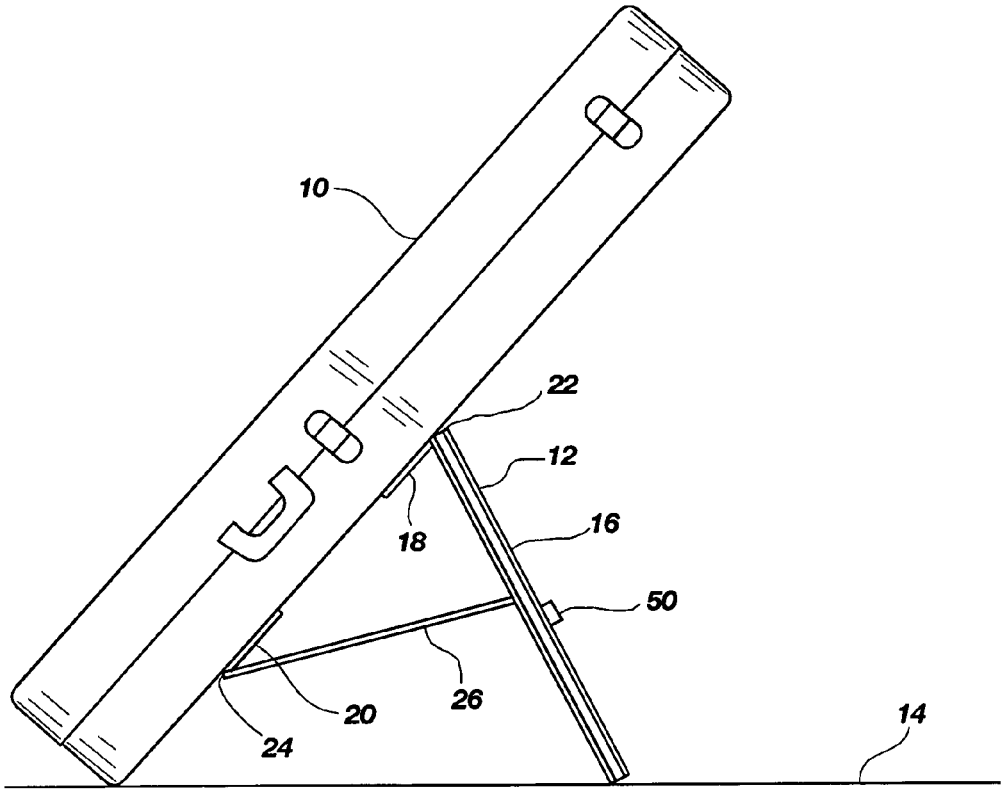
FIG. 2 is a side view of the instrument case and stand device of FIG. 1, with the stand device in an extended position.

As shown in FIG. 1, the stand 12 may be configured in a retracted position so as to be compact and unobtrusive. The stand 12 may thus be transported and stored along with the case 10. Moreover, as shown in FIG. 2, the stand 12 may be configured in an extended position so that the case 10 may be supported in an upright position with respect to a floor 14 or other support surface. Accordingly, the musical instrument may remain within the case 10 so as to be protected from dust or adverse weather conditions. Moreover, the instrument may be less accessible in the case 10 and may therefore be less susceptible to accidental damage caused by children or pets, for example.

Figure 3:
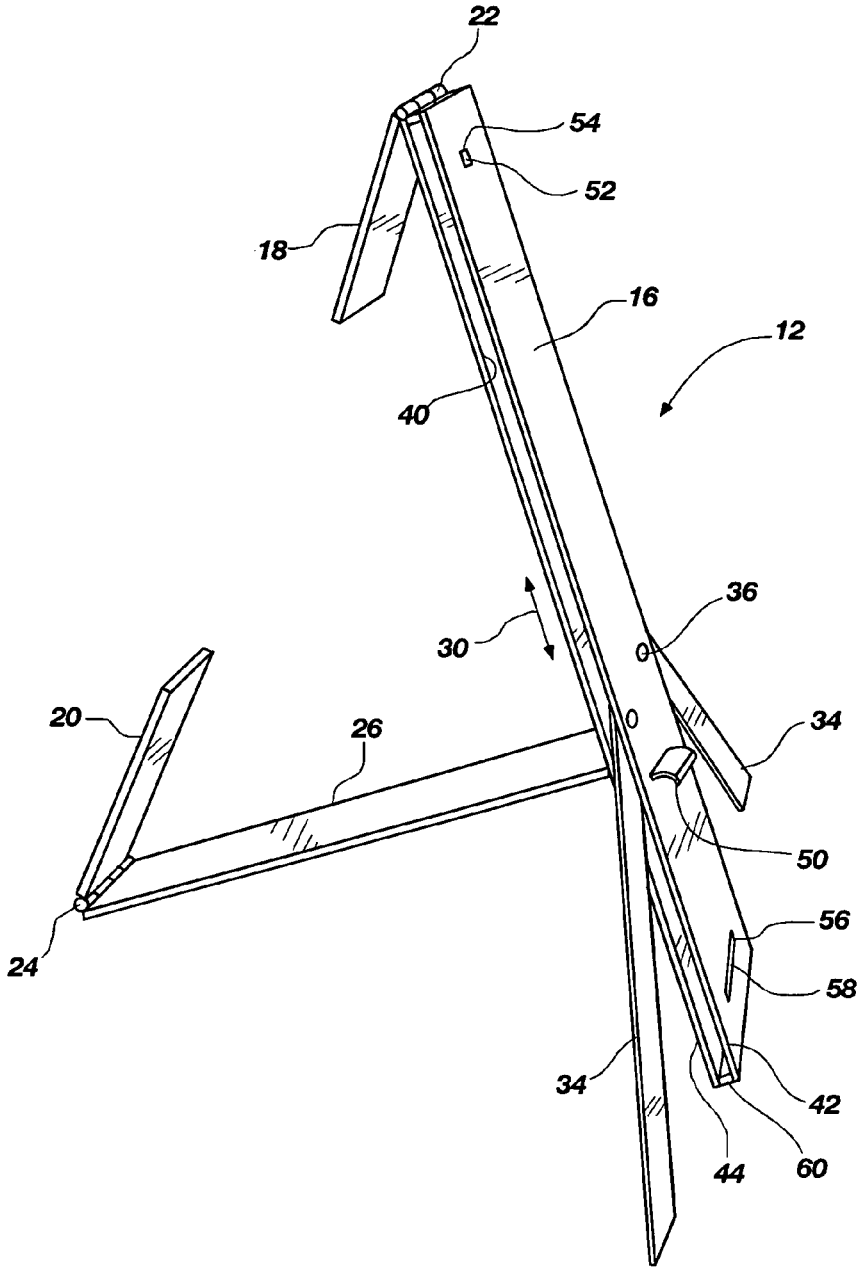
FIG. 3 is a perspective view of the stand device of FIG. 1, in an extended position.

Referring now to FIG. 3, a perspective view of the stand device 12 is shown. The stand device 12 may include a body 16 configured to extend from the case 10 to the floor 14, to support the case 10 in an upright orientation. The body 16 may have various different sizes and shapes, and may be thin so as to be easily manipulated along with the case 10 without adding substantial bulk to the case 10. For example, one embodiment of the present disclosure may have a thickness of approximately one half inch. However, it will be understood that body 16 may have other thicknesses within the scope of the present disclosure.

The stand 12 may also include attaching means for attaching the stand 12 to the case 10. The attaching means may include one or more connectors, such as a first connector 18 for attaching the stand 12 at a first area of attachment on the case 10, and a second connector 20 for attaching the stand 12 on a second area of attachment on the case 10. The first connector 18 and the second connector 20 may be formed of flat members having fasteners such as VELCRO hook and loop fasteners for example. Accordingly, the first connector 18 and the second connector 20 may be removably attached to the case 10. Other temporary or permanent fastening devices may also be used to attach the first connector 18 and the second connector 20 to the case 10.

One embodiment of the first connector 18 and the second connector 20 may include flat members configured and dimensioned to fit at least partially within the body 16. Other embodiments of the first connector 18 and the second connector 20 may be configured to fit substantially completely within the body 16. Moreover, the first connector 18 and the second connector 20 may be separated so as to be movable with respect to each other prior to attachment to the case 10, whereas the first connector 18 and the second connector 20 may be fixed with respect to each other once they are attached to the case 10. This configuration of the first connector 18 and the second connector 20 may provide for an adjustably versatile arrangement such that positioning of the first connector 18 and second connector 20 on the case 10 may be facilitated. Other embodiments of the present disclosure may include a first connector 18 and a second connector 20 that may be joined together such that the first connector 18 and the second connector 20 are not moveable with respect to each other even prior to being attached to the case 10.

The first connector 18 may have a first hinge 22. One embodiment of the stand 12 may include the first hinge 22 positioned on an upper end of the first connector 18. Alternatively, the first hinge 22 may be positioned at other locations on the first connector 18. The first hinge 22 may be formed in any manner known in the art to allow the body 16 to be rotatably attached to the first connector 18.

One embodiment of the present disclosure may include the first hinge 22 formed as a living hinge. As used herein, the term "living hinge" shall be construed broadly to include sections of a material, such as plastic, that may form a connection between two segments of a part to keep the segments attached together and allow the segments to be rotated with respect to each other. The materials used to make a living hinge may be a thin, very flexible plastic such as polypropylene or polyethylene, for example, which can flex numerous times without failure. Other embodiments of the first hinge 22 may be formed as a pin received in a cylinder, for example, or any other variety of hinge known to those skilled in the art.

It will be understood that the second connector 20 may also have a second hinge 24. The second hinge 24 may be positioned on a lower end of the second connector 20. Alternatively, the second hinge 24 may be positioned at other locations on the second connector 20. The second hinge 24 may be formed in any manner known in the art, similar to the first hinge 22 discussed above, including a living hinge.

Figure 6:
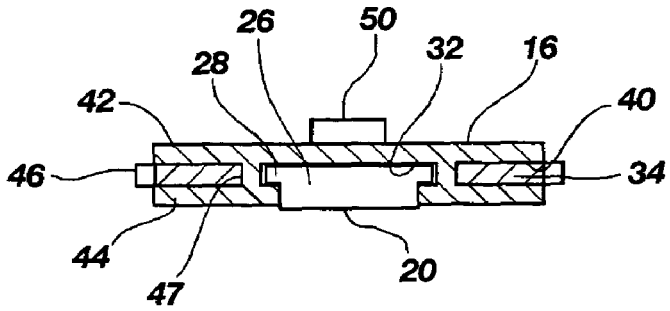
FIG. 6 is a top cross-sectional view of the stand device taken along line A—A in FIG. 5, with the legs in a retracted position.
Figure 10:
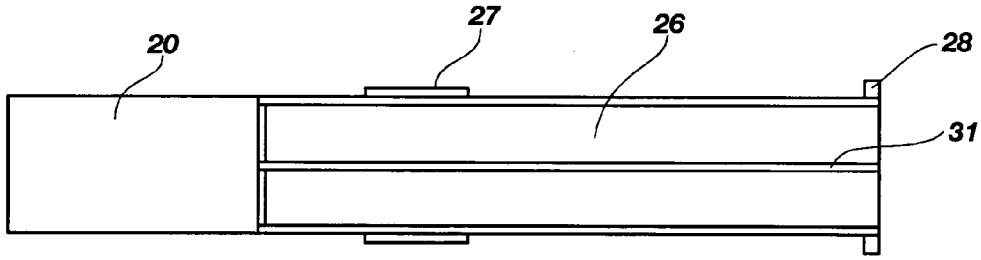
FIG. 10 is a front view of a brace of the stand device of FIG. 8.

A slider or brace member 26 may be attached to the second hinge 24 so that the brace 26 may be rotatably attached to the second connector 20. An end of the brace 26 opposite the second hinge 24 may include a pin-or projection 28, as best shown in FIGS. 6 and 10, for being slidably received in the body 16, such that the brace 26 can move with respect to the body 16 in a direction as indicated by arrow 30 in FIG. 3. It will be understood that when the stand 12 is in a retracted position, the brace 26 may be received within a cavity 32 in the body 16, as best shown in FIG. 6, and the pin 28 may be positioned toward an upper portion of the body 16. However, as the stand 12 is moved to an extended position, the pin 28 may slide down to a lower position in the body 16 to support the body 16 with respect to the case 10. A stop may be formed in the cavity 32 to limit movement of the brace 26 with respect to the body 16. The stop may be formed in any manner known in the art for abutting with the pin 28 to prevent movement of the pin 28 beyond a specified point. It will be appreciated that the stop may be positioned as desired such that the brace 26 forms the desired position with respect to the body 16 when the stand device 12 is in the extended position. It will also be appreciated that the brace 26 may have a connecting mechanism, such as hook and loop fasteners for example, to hold the brace 26 against the body 16 in a retracted position so that the body 16 may not inadvertently swing out to the extended position.

Figure 4:
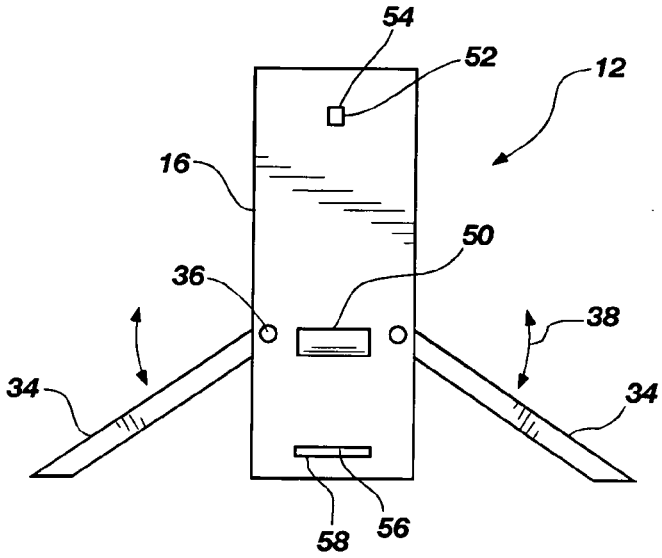
FIG. 4 is a front view of the stand device of FIG. 1 with legs in an extended position.
Figure 5:
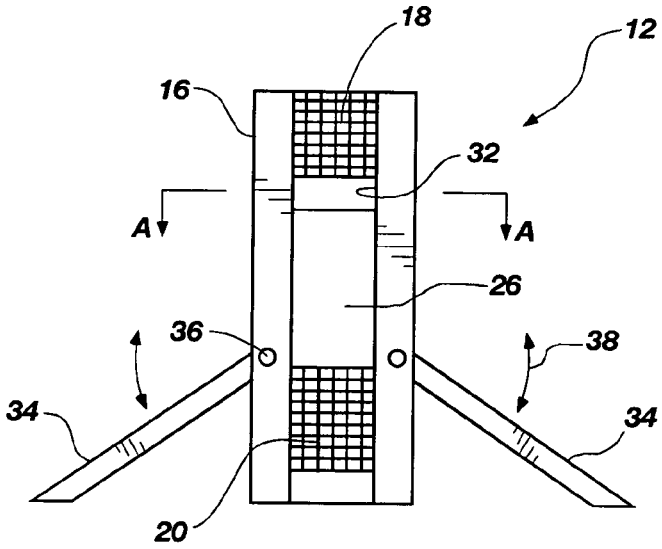
FIG. 5 is a rear view of the stand device of FIG. 1 with the legs in an extended position.

The stand device 12 may also include at least one leg 34. The stand device 12 may include two legs 34 that may be movably attached to the body 16 through connecting mechanisms such as pivots 36. The pivots 36 may include structures such as bolts, studs, screws or rivets, for example, to allow the legs 34 to be pivotally attached to the body 16. Accordingly, when the stand device 12 is in the retracted position, the legs 34 may be rotated to be stored within the body 16, whereas when the stand device 12 is in the extended position, the legs 34 may be rotated as shown by the arrow 38 in FIGS. 4–5 so as to contact the floor 14 to provide additional support and stability to the stand device 12.

Figure 7:
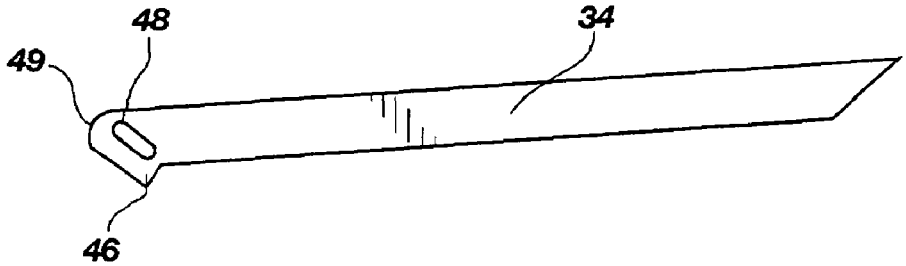
FIG. 7 is a front view of a leg of the stand device.
Figure 8:
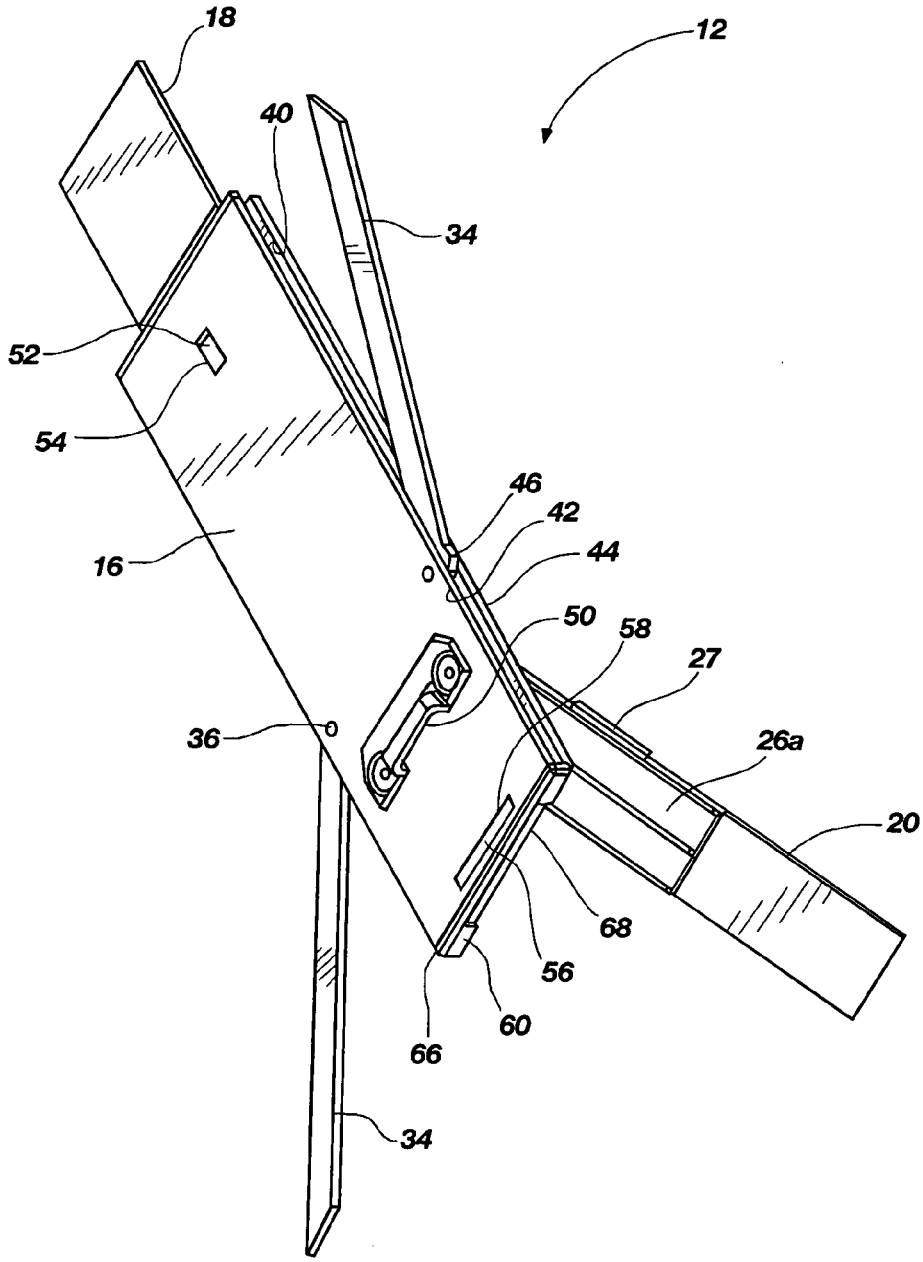
FIG. 8 is a perspective view of a stand device having one leg in an extended position and one leg in an intermediate position.

When the stand device 12 is in the retracted position, the legs 34 may be stored within grooves 40 in the body 16. The grooves 40 may extend along a side of the body 16 and may be defined by a first wall 42 and a second wall 44 forming the body 16. To assist in retrieving the legs 34 from the grooves 40, the legs 34 may be formed with accessing features such as protrusions 46, as best shown in FIGS. 1, 7 and 8. The protrusions 46 may be positioned so as to be accessible when the legs 34 are stored within the grooves 40. Moreover, the protrusions 46 may be configured to form stops to abut a bottom wall 47 of the grooves 40 so that the legs 34 may be supported in a desired angular position without over rotation of the legs 34. It will be understood that in some situations, if desired, the stand device 12 may be used in the extended position with the legs remaining stored within the grooves 40. Moreover, other embodiments of the stand device 12 may be provided without the legs 34, or without the grooves 40.

A locking mechanism may be used to lock the legs in the extended or retracted position. For example, the locking mechanism may include slots 48 in the legs 34, as best shown in FIG. 7, configured to receive the pivots 36. The slots 48 may be arranged such that when the leg 34 is moved upward so that the pivot 34 is in an end of the slot 48 nearest the protrusions 46, the end of the leg and the protrusion 46 may abut the bottom 47 of the groove 40 so as to prevent the leg 34 from rotating. However, when the leg 34 is lowered such that the pivot 34 is in an end of the slot 48 away from the protrusion 46, a rounded edge 49 may not abut the bottom 47 of the groove 40 so that the leg 34 can be rotated upwardly to fit within the groove 40. It will be understood that other locking mechanisms may be used to hold the legs 34 in the extended or retracted position within the scope of the present disclosure, and that some embodiments may not include a locking mechanism for holding the legs 34.

The stand device 12 may also include a handle 50 for allowing the stand device 12 to be grasped to be adjusted from the retracted position to the extended position. The handle 50 may have any of a variety of shapes and configurations for facilitating grasping and moving of the stand device 12. Other embodiments of the stand device may be formed without a handle 50.

It will be understood that the components of the stand device 12 may be formed of various different materials having suitable strength and durability characteristics. For example, the stand device 12 may be formed of various types of plastic, metal, wood or composite materials.

Referring now to FIG. 8, a perspective view is shown of a stand device 12 with an alternative embodiment brace 26*a*. As previously discussed, the presently disclosed embodiments are merely exemplary of the possible embodiments of the disclosure, including that illustrated in FIG. 8.

It will be appreciated that the embodiment of the disclosure illustrated in FIG. 8 contains many of the same structures represented in FIGS. 1–7 and only the new or different structures will be explained to most succinctly explain the additional advantages which come with the embodiment of the disclosure illustrated in FIG. 8.

Figure 9:
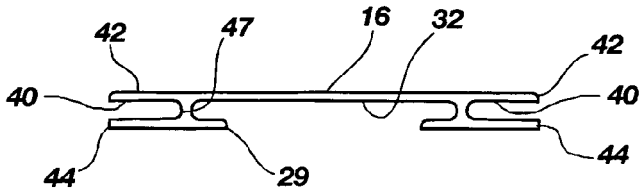
FIG. 9 is an end view of a body of the stand device of FIG. 8.

The alternative embodiment brace 26*a* may include one or more catches 27 for locking the brace 26*a* within the cavity 32 of the body 16. The catches 27 may be formed as resilient members extending along an edge of the brace 26*a*. As shown most clearly in FIG. 9, which shows an end view of the body 16, a lip 29 may be formed on the body 16 for maintaining the pin 28 of the brace 26*a* within the cavity 32, and also for abutting with the catch 27 for holding the brace 26*a* within the cavity 32. Accordingly, the catches 27 may deflect when the brace 26*a* is pressed against the body 16 until they snap into the cavity 32. Thus, the brace 26*a* may be maintained within the cavity 32. However, when the handle 50 is grasped and a force is applied to the body 16 to pull the body 16 away from the case 10 or other object, the catches 27 may again deflect to allow the brace 26*a* to be pulled out of the cavity 32. The lips 29 may include a tapered surface to facilitate removing the catches 27 from the cavity 32. As discussed above, it will be understood that other embodiments of the brace 26*a* may be provided with different attaching mechanisms for holding the brace 26*a* within the cavity 32.

Figure 11:
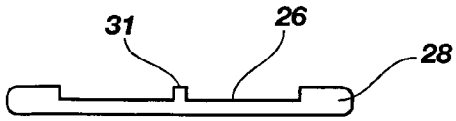
FIG. 11 is an end view of the brace of FIG. 10.

It will be understood that one embodiment of the brace 26*a* may be formed as a thin member, as shown in the end view of FIG. 11. Ribs 31 may be formed on the brace 26*a* to provide additional stability to the brace 26*a*. One embodiment of the brace 26*a* may include ribs extending along the exterior edges of the brace 26*a* and along the center of the brace 26*a*. It will be understood, however, that other embodiments of the brace 26*a* may be formed with ribs 31 in different locations or configurations. Moreover, some embodiments may have different quantities of ribs, or no ribs at all.

Figure 12:
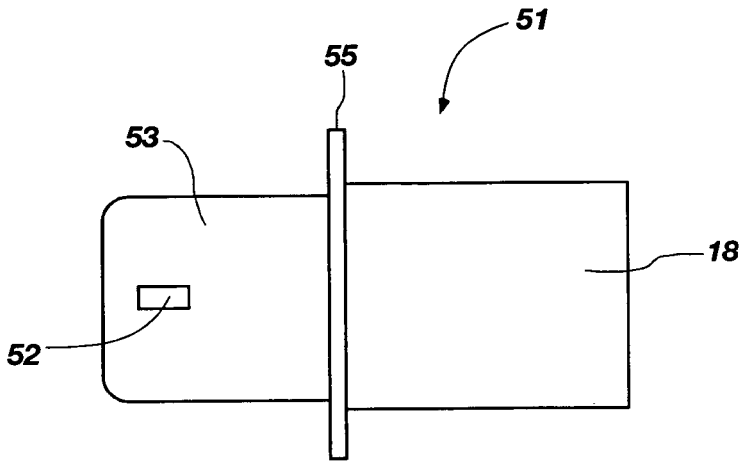
FIG. 12 is a front view of a top cap of the stand device of FIG. 8.
Figure 13:
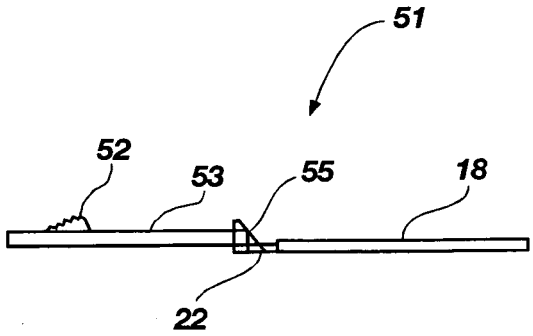
FIG. 13 is a side view of the top cap of FIG. 12.
Figure 14:
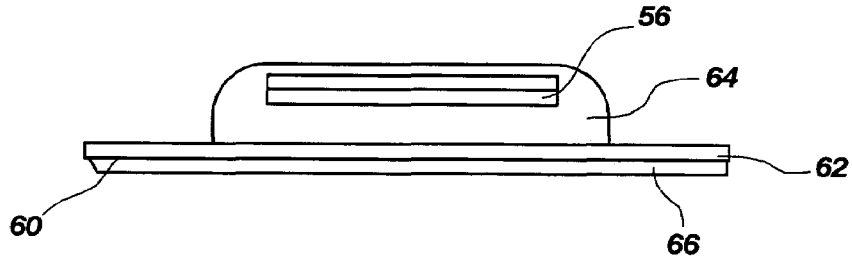
FIG. 14 is a front view of a bottom cap of the brace of FIG. 8.
Figure 15:
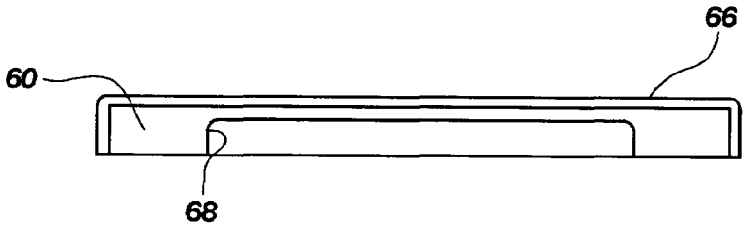
FIG. 15 is a bottom view of the bottom cap of FIG. 14.
Figure 16:
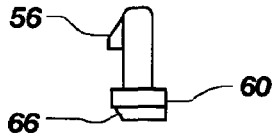
FIG. 16 is an end view of the bottom cap of FIG. 14.

Referring now to FIG. 12, a front view of a top cap 51 is shown of the stand device 12 of FIG. 8. It will be understood that the top cap 51 may be attached to the body 16 in a snap-fit arrangement. The top cap 51 may include an insert 53 attached to the first connector 18. The insert 53 may include a tab 52 which may be configured to snap into a window 54 in the body 16. As shown in FIG. 13, the tab 52 may include a tapered surface configured to project from the insert 53 for engaging with the perimeter of the window 54. A cover 55 may be provided between the insert 53 and the first connector 18 for covering an end of the body 16. It will be understood that the top cap 51 may be formed as a one piece unitary member and that the hinge 22 may be formed integral with the top cap 51 in the form of a living hinge. Alternatively, the top cap 51 may be formed of multiple pieces joined together. Moreover, it will be understood that other embodiments of the stand device 12 may be formed without a top cap 51. For example, the first connector 18 may be joined directly to the body 16 without an insert 53 or cover 55. Other embodiments may include the connector 18 joined to the insert 53 without a cover 55.

Similarly, a bottom cap 60 may be provided as best shown in FIGS. 8 and 14–16. The bottom cap 60 may include a bottom cover 62 for covering a bottom of the body 16. A bottom insert 64 may be provided on the bottom cover 62 for inserting into the bottom of the cavity 32. A bottom tab 56 may be provided on the bottom insert 64. The bottom tab 56 may be formed as a tapered projection similar to the tab 52 for being received in a bottom window 58 in a snap-fit engagement. Accordingly, the bottom cap 60 may be placed over a bottom of the body 16 and the bottom tab 56 may hold the bottom cap 60 in place.

One embodiment of the bottom cap 60 may be formed with a beveled edge 66 and a recess 68. The recess 68 may be used to facilitate grasping the body 16 to move the body 16 to an extended position. Other embodiments of the bottom cap 60 may include features to assist in gripping the floor. Moreover, it will be understood that the bottom cap 60 may be formed in various different configurations within the scope of the present disclosure. It will also be appreciated that the stand 12 may be assembled using other mechanisms without a bottom cap 60 within the scope of the present disclosure.

In use, the stand device 12 may be attached to an object, such as an instrument case 10, by attaching fasteners, such as hook and loop fasteners, to the instrument case 10. Any variety of adhesive or fastening devices known in the art may be used to attach the hook and loop fasteners to the instrument case 10. Then the first connector 18 and the second connector 20 may also be attached to the instrument case 10 using the hook and loop fasteners. The stand device 12 may be placed in the extended position by grasping the handle 50 and pulling the body 16 away from the instrument case 10 causing the brace 26 to be lowered until the pin 28 on the brace 26 arrives at the stop (not shown). Then the legs 34 may be rotated out of the grooves 40 until they become even with the bottom of the body 16 and the legs 34 may be lifted such that the pivots 36 slide in the slots 48 to a position in which the legs 34 may be locked in place. The instrument case 10 may then be supported on the floor 14 or other support surface in an upright position with the bottom of the instrument case 10 as well as the body 16 and legs 34 in contact with the floor 14. The musical instrument may be safely stored within the instrument case 10. When it is desired to transport the musical instrument, the legs 34 may be pushed down to an unlocked position and rotated into the grooves 40, and the body 16 may be pushed toward the instrument case 10 such that the brace 26, the first connector 18 and the second connector 20 may be stored and hidden from view within the cavity 32. The stand device 12 may then be locked in the retracted position to have a sleek and aesthetically pleasing appearance. Moreover, the compact configuration of the stand device 12 facilitates transporting and handling of the stand device 12.

It will be appreciated that the structure and apparatus disclosed herein is merely one example of a means for attaching a stand to an object, and it should be appreciated that any structure, apparatus or system for attaching a stand to an object which performs functions the same as, or equivalent to, those disclosed herein are intended to fall within the scope of a means for attaching a stand to an object, including those structures, apparatus or systems for attaching a stand to an object which are presently known, or which may become available in the future. Anything which functions the same as, or equivalently to, a means for attaching a stand to an object falls within the scope of this element.

Similarly, it will be appreciated that the structure and apparatus disclosed herein is merely one example of an extendable retractable means, and it should be appreciated that any structure, apparatus or system for extending and retracting which performs functions the same as, or equivalent to, those disclosed herein are intended to fall within the scope of an extendable retractable means, including those structures, apparatus or systems for extending and retracting which are presently known, or which may become available in the future. Anything which functions the same as, or equivalently to, an extendable retractable means falls within the scope of this element.

In accordance with the features and combinations described above, a useful method for storing an object may include the steps of:

(a) attaching a first connector to the object;

(b) attaching a body to the first connector;

(c) attaching a brace to the body;

(d) extending the body from the object to support the object in an upright position with respect to a support surface; and (f) retracting the body against the object to position the first connector and the brace within the body thereby obscuring the first connector and the brace from view.

Those having ordinary skill in the relevant art will appreciate the advantages provide by the features of the present disclosure. For example, it is a feature of the present disclosure to provide a stand device that is simple in design and manufacture. Another feature of the present disclosure is to provide such a stand device capable of being configured in a retracted position so as to be easily handled and stored. It is a further feature of the present disclosure, in accordance with one aspect thereof, to provide stand device that allows a musical instrument to be stored in its case to provide protection to the musical instrument against the elements or accidental damage. Another feature of the present disclosure is to provide a stand device that has an aesthetically pleasant appearance.

In the foregoing Detailed Description, various features of the present disclosure are grouped together in a single embodiment for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A device for supporting an object, said device comprising:

a connector for attaching said device to said object;

a body attached to said connector, said body extendable from a retracted position to an extended position for contacting a surface to support said object;

a brace attached to said body for supporting said body against said object; and at least one leg attached to said body, said at least one leg being configured for contacting said surface to add stability to said body;

wherein said connector and said brace are receivable within said body when said body is in said retracted position such that said device can be arranged in a compact configuration.

2. The device of claim 1, wherein said connector and said body are attached together through a hinge.

3. The device of claim 1, wherein said connector comprises a substantially flat member comprising fasteners.

4. The device of claim 3, wherein said fasteners comprise hook and loop fasteners.

5. The device of claim 1, further comprising a second connector disposed on said brace for attaching said brace to said object.

6. The device of claim 1, wherein said brace comprises a projection slidably received in said body such that said brace is movable with respect to said body.

7. The device of claim 1, wherein said body comprises a cavity for receiving said brace therein.

8. The device of claim 1, wherein said at least one leg comprises two legs, said legs being pivotally attached to said body.

9. The device of claim 1, wherein said at least one leg comprises a protrusion for controlling movement of said at least one leg.

10. The device of claim 1, wherein said at least one leg comprises a slot for receiving a pivot therethrough for attaching said at least one leg to said body.

11. The device of claim 1, wherein said object is an instrument case.

12. A device for supporting an object, said device comprising:

a connector for attaching said device to said object;

a body attached to said connector, said body extendable from a retracted position to an extended position for contacting a surface to support said object;

a brace attached to said body for supporting said body against said object;

a second connector disposed on said brace for attaching said brace to said object;

wherein said connector and said brace are receivable within said body when said body is in said retracted position such that said device can be arranged in a compact configuration; and wherein said second connector comprises a second hinge.

13. A device for supporting an object, said device comprising:

a connector for attaching said device to said object;

a body attached to said connector, said body extendable from a retracted position to an extended position for contacting a surface to support said object; and a brace attached to said body for supporting said body against said object;

wherein said connector and said brace are receivable within said body when said body is in said retracted position such that said device can be arranged in a compact configuration; and wherein said body comprises a groove extending along a side of said body for receiving a leg therein.

14. The device of claim 13, wherein said object is an instrument case.

15. The device of claim 13, wherein said connector and said body are attached together through a hinge.

16. The device of claim 13, wherein said connector comprises a substantially flat member comprising fasteners.

17. The device of claim 13, wherein said body comprises a cavity for receiving said brace therein.

18. A device for supporting an object, said device comprising:

a connector for attaching said device to said object;

a body attached to said connector, said body extendable from a retracted position to an extended position for contacting a surface to support said object; and a brace attached to said body for supporting said body against said object;

wherein said connector and said brace are receivable within said body when said body is in said retracted position such that said device can be arranged in a compact configuration; and wherein said body comprises a handle for allowing said body to be grasped to be adjusted from said retracted position to said extended position.

19. The device of claim 18, wherein said connector and said body are attached together through a hinge.

20. The device of claim 18, wherein said connector comprises a substantially flat member comprising fasteners.

21. The device of claim 20, wherein said fasteners comprise hook and loop fasteners.

22. The device of claim 18, further comprising a second connector disposed on said brace for attaching said brace to said object.

23. The device of claim 18, wherein said brace comprises a projection slidably received in said body such that said brace is movable with respect to said body.

24. The device of claim 18, wherein said body comprises a cavity for receiving said brace therein.

25. The device of claim 18, wherein said object is an instrument case.

26. A device for supporting an object, said device comprising:

a connector for attaching said device to said object;

a body attached to said connector, said body extendable from a retracted position to an extended position for contacting a surface to support said object; and a brace attached to said body for supporting said body against said object;

wherein said connector and said brace are receivable within said body when said body is in said retracted position such that said device can be arranged in a compact configuration;

wherein said connector and said body are attached together through a first hinge, said first hinge being positioned at an upper end of said connector;

wherein said connector comprises a substantially flat member comprising fasteners, wherein said fasteners comprise hook and loop fasteners;

wherein said device further comprises a second connector disposed on said brace for attaching said brace to said object, said second connector comprising a second hinge located on a lower end of said second connector;

wherein at least one of said first hinge and said second hinge is a living hinge;

wherein said brace comprises a projection disposed at an end of said brace opposite said second connector, said projection being slidably received in said body such that said brace is movable with respect to said body;

wherein said body comprises a cavity for receiving said brace, said connector and said second connector therein;

wherein said device comprises at least one leg attached to said body, said at least one leg being configured for contacting said surface to add stability to said body;

wherein said at least one leg comprises a protrusion for controlling movement of said at least one leg;

wherein said at least one leg comprises a slot for receiving a pivot therethrough for attaching said at least one leg to said body;

wherein said at least one leg comprises two legs, said legs being pivotally attached to said body;

wherein said body comprises a groove extending along opposite sides of said body, said groove being configured for receiving said legs therein;

wherein said body comprises a handle for allowing said body to be grasped to be adjusted from said retracted position to said extended position.

* * * * *